US007152998B2

(12) United States Patent
Rahman

(10) Patent No.: US 7,152,998 B2
(45) Date of Patent: Dec. 26, 2006

(54) ASSEMBLABLE STRING TREE

(76) Inventor: Najeh Rahman, 55 Melody La., Harriman, NY (US) 10926

( * ) Notice: Subject to any disclaimer, the term of this patent is extended or adjusted under 35 U.S.C. 154(b) by 120 days.

(21) Appl. No.: 10/849,727

(22) Filed: May 20, 2004

(65) Prior Publication Data

US 2005/0260360 A1 Nov. 24, 2005

(51) Int. Cl.
*F21S 13/14* (2006.01)

(52) U.S. Cl. ..... 362/252; 362/123; 362/806

(58) Field of Classification Search ..... 362/123, 362/249, 250, 252, 805, 806
See application file for complete search history.

(56) References Cited

U.S. PATENT DOCUMENTS 3,704,366 A * 11/1972 Korb et al. ..... 362/123
6,254,250 B1 * 7/2001 Shieh ..... 362/123
6,334,694 B1 * 1/2002 Huang ..... 362/123
6,458,435 B1 * 10/2002 Lai ..... 428/20
6,652,927 B1 11/2003 Chen
6,679,622 B1 * 1/2004 Kao ..... 362/567

OTHER PUBLICATIONS

Adams Manufacturing Catalog, "Holiday Decoration Accessories" See Christmas Eaves Tree Kit on p. 4.
Photographs of Christmas String Tree assembled from kit from Grand Asia Electric Co., Ltd. of Zhongshan, Gaungdong, China.

* cited by examiner

*Primary Examiner*—John Anthony Ward
(74) *Attorney, Agent, or Firm*—Amster, Rothstein & Ebenstein LLP

(57) ABSTRACT

An assemblable string tree wherein, when completely assembled, a pole vertically supports a hanger above a base with light strings extending generally downwardly and outwardly between hanger engagements and base engagements such that the light strings cumulatively provide the general appearance of an upright truncated cone.

20 Claims, 6 Drawing Sheets

ASSEMBLABLE STRING TREE

BACKGROUND OF THE INVENTION

The present invention relates to a string tree, more particularly to a string tree which is easily assembled and dissembled.

A Christmas tree, in its basic form, has the outline of an upright cone or in some instances such an upright cone which has been truncated at the top. While decorative minature or midget lamps are preferably disposed not only on the periphery of the tree, but also in the interior thereof (that is, along the branches thereof), a visual approximation thereof is obtainable by providing an upright cone with light strings extending in straight lines along the periphery of the cone between the top and bottom thereof. Such an arrangement of light strings and the structure supporting the same are known as a "string tree".

String trees may be made with each of the light strings providing steady illumination or with some or all of the light strings flashing on and off in unison or in sequence. Alternatively, each light string or group of light strings may flash independently of other light strings or groups of light strings. Indeed, individually shunted flashing lamps (commonly called "twinkle bulbs") may be used to create random flashing of individual lamps along a given light string. Further, controllers may be used to cause lamps or light strings to flash in various patterns selected by the user.

A string tree may vary greatly in height and base diameter depending, to a large degree, on whether they are to be deployed as a table ornament, as a room ornament (much as a traditional Christmas tree), or as an outdoor structure. However, regardless of the size of the string tree, for shipping and storage purposes it is critical that the string tree be easily, simply and quickly convertible between its assembled conical use or display orientation and its disassembled flat or planar storage/shipment orientation (preferably in a sturdy package providing some protection, especially for the fragile lamps). For a string tree of substantial size, shipment from a manufacturer or retailer in the use orientation would not be economical and, therefore, it falls upon the unskilled user not only to initially assemble the string tree into the use orientation, at the beginning of the season to but also at the end of the season to disassemble it into the storage orientation (for reassembling into the use orientation at the beginning of the next season). Clearly, conversion between the planar storage orientation and the conical use orientation should be as simple, easy and quick as possible.

Accordingly, it is an object to provide a string tree, characterized by a disassembled planar storage orientation and an assembled conical use orientation, which in a preferred embodiment is easily, simply and quickly converted from one orientation to the other even by a relatively unskilled user.

Another object is to provide such a string tree which in a preferred embodiment is simple, easy and economical to manufacture, use and maintain.

A further object is to provide a method for simply, easily and quickly, assembling and disassembling such a string tree.

SUMMARY OF THE INVENTION

It has now been found that that the above and related objects of the present invention are obtained in a first embodiment of a string tree, prior to complete assembly thereof, comprising a base, a hanger, a pole means, a light set and securing means. The substantially planar wheel-base defines a base rim, a base hub, and base connection means connecting the base rim and the base hub, the base rim additionally defining a plurality of spaced base engagement means. The substantially planar wheel-like hanger defines a hanger rim, a hanger hub, and a hub connection means connecting the hanger rim and the hanger hub, the hanger rim additionally defining a plurality of spaced hanger engagement means, the hanger rim having a diameter substantially less than that of the base rim. The pole means is adapted for releasable attachment at one end of the base hub and at an opposite end to the hanger hub for thereby connecting the hubs in a vertically spaced relationship. The light set defines a common means and a plurality of flexible light strings extending therefrom, each light string containing miniature or midget lamps, being in electrical communication with the common means, and extending from a respective one of one of the hanger engagement means is secured to a corresponding one of the hanger rim and the base rim. Means are provided for releasably manually securing the free end of each of the light strings to a respective other one of the hanger engagement means When the string tree is completely assembled, the pole means vertically supports the hanger above the base with the light strings extending generally downwardly and outwardly between the hanger engagement means and the base engagement means such that the light strings cumulatively provide the general appearance of an upright truncated cone.

Preferably the string tree additionally includes a tree-topper ornament removably securable to the top of the pole means, the ornament being electrically illuminatable and in electrical communication with the light set—e.g., by an additional light string of the light set in electrical communication with both the common wire means and the ornament.

It is preferred that the common means is secured to the hanger rim so that each light string extends downwardly from a respective one of the hanger engagement means. The securing means is for manually releasably securing the free end of each light string to a respective one of the base engagement means.

In a preferred design each of the base and hanger rims is generally circular, and each of the base and hanger connecting means is a plurality of circumferentially-spaced spokes.

The present invention additionally encompasses a method of assembling such a string tree comprising the steps of assembling the pole means and the hubs with one end of the pole means secured to the base hub and the other end of the pole means secured to the hanger hub, thereby to vertically support the hanger above the base, and then extending the light strings from respective ones of the hanger and base engagement means, and manually releasably securing each free end of the light strings to a respective other one of the hanger and base engagement means, thereby to cause the light strings cumulatively to give the appearance of an upright truncated cone. Preferably the light strings are allowed to depend from the hanger engagement means, and the free ends thereof are secured to the base engagement means.

In a second embodiment, the string tree additionally comprises at least one substantially planar wheel-like intermediate structure defining an intermediate rim, an intermediate hub for releasable attachment to the pole means, and a plurality of intermediate connection means connecting the intermediate rim and the intermediate hub, the intermediate rim additionally defining a plurality of circumferentially-spaced intermediate engagement means. The intermediate rim is of appreciable width, and each light string is capable of generally horizontally traversing the width of the intermediate rim and being securable to at least a respective one of the intermediate engagement means. When the string tree is completed assembled, the pole means vertically supports the intermediate structure between the hanger and the base with the light strings defining at least one generally horizontal jag between the hanger and the base such that the light strings cumulatively provide the general appearance of a vertical series of truncated cones.

Preferably, when the second embodiment of the string tree is completely assembled, each light string engages a respective one of the intermediate engagement means and inwardly and generally horizontally traverses the width of the intermediate rim such that the light strings cumulatively provide the general appearance of a stack of upright truncated cones. The intermediate rim preferably has an outer diameter intermediate the hanger and base diameters.

The present invention also encompasses a method of assembling the second embodiment of the string tree comprising the steps of assembling the pole means and the hubs with one end of the pole means secured to the base hub, an intermediate portion of the pole means secured to the intermediate hub, and the other end of the pole means secured to the hanger hub, thereby to vertically support the hanger above the base with the intermediate structure therebetween, and then extending the light strings from respective ones of the hanger and base engagement means and across the intermediate rim, and manually releasably securing each free end of the light strings to a respective other one of the hanger and base engagement means, thereby to cause the light strings cumulatively to give the appearance of a vertical series of upright truncated cones. The method preferably additionally includes the step of engaging each intermediate portion of each light string with a respective intermediate engagement means.

The present invention also encompasses a string tree composite comprising a plurality of string trees and means for assembling the plurality of pole means of the plurality of string trees to form a single pole joining the plurality of string trees along a vertical axis. When the composite is completely assembled, the pole vertically supports the plurality of string trees, one above the other, to form the composite. The plurality of light sets of the plurality of string trees are either electrically independent and separate or in electrical communication to form a single large light set.

BRIEF DESCRIPTION OF THE DRAWING

The above and related objects of the present invention will be more fully understood by reference to the following detailed description of the presently preferred, albeit illustrative, embodiments of the present invention when taken in conjunction with the accompanying drawing wherein.

DETAILED DESCRIPTION OF THE PREFERRED EMBODIMENTS

Figure 1:
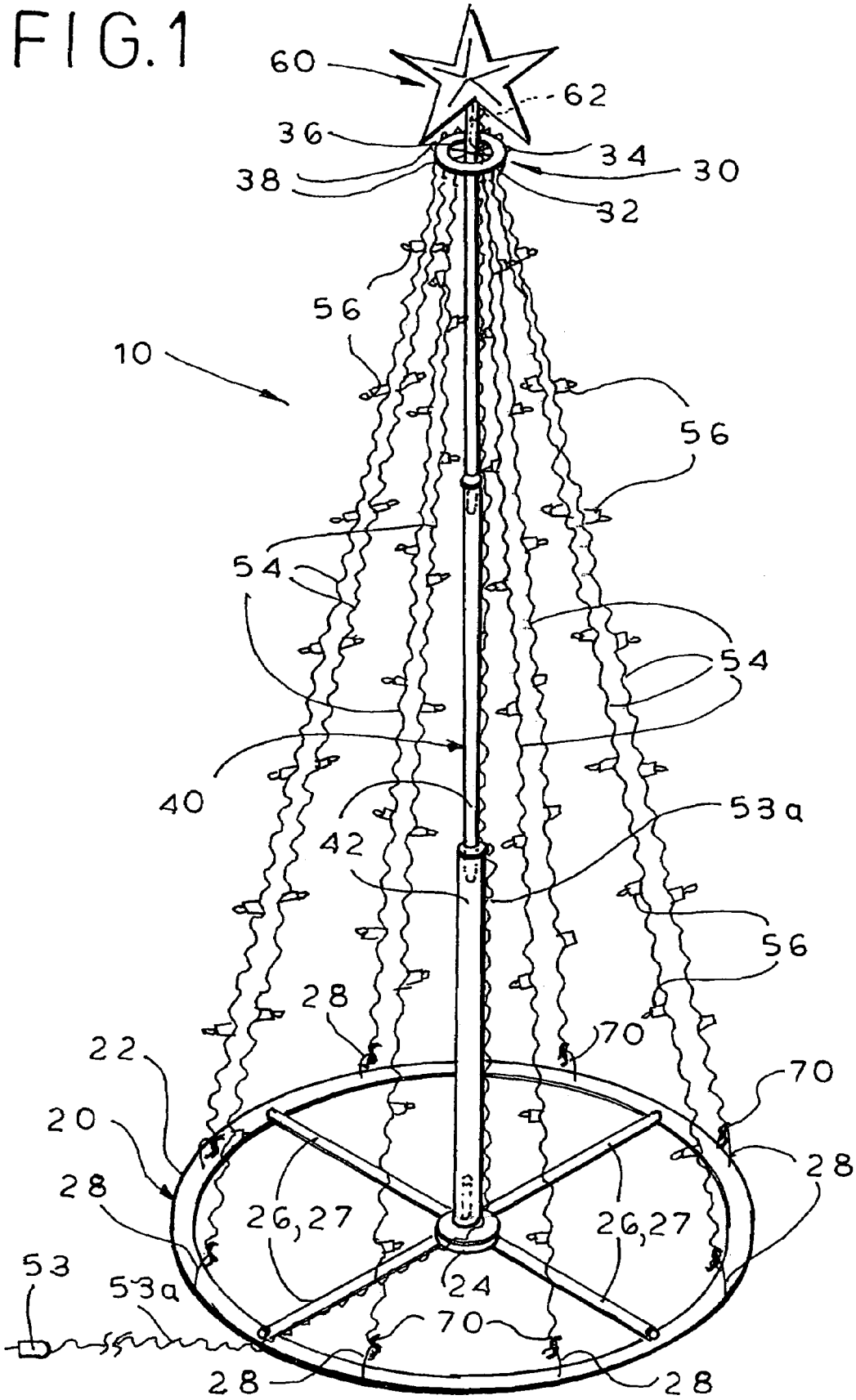
FIG. 1 is an isometric view of a first embodiment of a string tree according to the present invention after complete assembly thereof.
Figure 2:
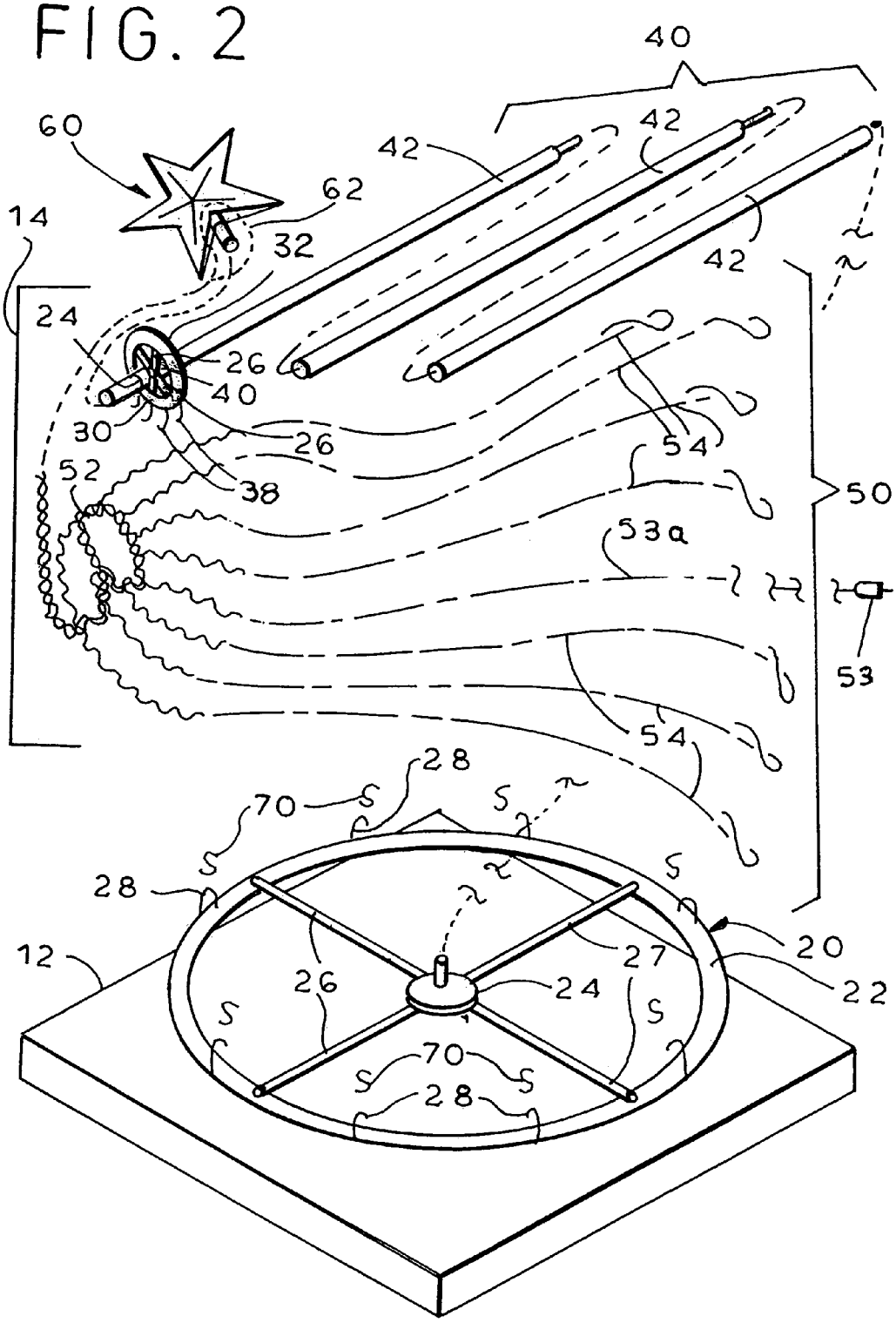
FIG. 2 is an exploded isometric view thereof.

Referring now to the drawing, and in particular to FIG. 1 thereof, therein illustrated is a string tree according to the present invention, generally designated made by the reference numeral 10, after complete assembly thereof. FIG. 2 is an exploded isometric view of the string tree 10, showing the individual components thereof, including a box or like packaging 12 in which the same may be shipped and stored. It will be appreciated, however, that two individual components—namely, the light set and the hanger—are normally joined together as an inseparable subunit 14.

More particularly, the string tree 10 comprises a substantially planar or flat wheel-like base, generally designated 20. The base 20 defines in turn a generally circular base rim 22, a base hub 24, and base connection means 26 connecting the base rim 22 and the base hub 24. The base rim 22 additionally defines a plurality of circumferentially-spaced base engagement means 28, the function of which will become apparent hereinafter.

The string tree 10 additionally comprises a substantially planar or flat wheel-like hanger, generally designated 30. The hanger 30 defines in turn a generally circular hanger rim 32, a hanger hub 34, and hub connection means 36 connecting the hanger rim 32 and the hanger hub 34. The hanger rim 32 additionally defines a plurality of circumferentially-spaced hanger engagement means 38, the function of which will become apparent hereinafter.

It will be appreciated that the hanger rim 32 has a diameter substantially less than that of the base rim 22. Where necessary because of its size, the base rim 22 may itself be formed of releasably interfitting segments (not shown), for example, to facilitate fitting into the packaging 12.

The base hub 24 is centrally located within the base rim 22, and the hanger hub 34 is centrally disposed within the hanger rim 32. The base connection means 26 is preferably a plurality of circumferentially-spaced base spokes 27 radially connecting the base rim 22 and the base hub 24, and the hub connection means 36 is preferably a plurality of circumferentially-spaced hanger spokes 37 radially connecting the hanger rim 32 and the hanger hub 34. Alternatively, each connection means 26, 36 may be of a helical or spiral design connecting the rims 22, 32 and hubs 24, 34, respectively. While the rims 22, 32, are preferably generally circular, they may in fact be polygonal or irregular in nature.

The string tree 10 additionally comprises a pole means, generally designated 40, for releasable attachment at one end to the base hub 24 and at the opposite end to the hanger hub 34, for thereby connecting the hubs 24, 34 in a vertically spaced relationship when the string tree 10 is supported on the base 20. In order to enable the circumference of a relatively high string tree 10 to fit within the packaging 12 (which is generally not much greater in size than is required to accommodate the base rim 22), the pole means 40 is preferably formed of a plurality of segments 42 configured and dimensioned to be easily releasably assembled together in end-to-end relationship to form a pole means 40 of greater length than any individual segment 42. Those skilled in the mechanical arts will readily appreciate how the various segments 42 may be combined to form the pole means 40 and how the ends of the pole means 40 may be releasably connected to the hubs 24, 34. By way of example only, a short vertical downward extension of the hanger hub 34 fits over and receives therein an upper end of a top pole segment 42, while the bottom end of the segment 42 fits over and receives the upper end of the next lower segment 42, etc. until the bottom end of the bottom segment 42 fits over and receives therein a short vertical upward extension of the base hub 24.

For illumination purposes, the string tree 10 additionally comprises a light set, generally designated 50. The light set 50 in turn includes a common wire means 52, including an active electrical wire and a return electrical wire, an electric plug 53, and a plurality of flexible light strings 54 in parallel electrical communication with the common means 52. The common means 52 of the light set 50 is preferably non-releasably secured to the appropriate base rim 22 or hanger rim 32, preferably the latter, to form a subunit 14. The common wire means 52 may be flexible or generally circular and conforming to the appropriate rim 22, 32. It may extend only once about the rim 22, 32 (as shown) or a plurality of times about the rim 22, 32 in order to provide the desired density of light strings 54 on the outer surface of the string tree 10.

The common means 52 is secured to one of the base rim 22 and the hanger rim 32, with each of the light strings 54 extending from the engagement means 28, 38 associated with that rim 22, 32. As illustrated, preferably the common means 52 is secured to the hanger rim 32, and the light strings 54 depend downwardly from the hanger engagement means 38. Alternatively, however, the common means 52 may be secured to the base rim 22, and the light strings 54 will then have to be manually extended upwardly from respective ones of the base engagement means 38 during assembly. Preferably the light set 50 is associated with the hanger 30 rather than the base 20 so that the individual light strings 54 will drop down of their own accord, under the influence of gravity, towards the base 20. Where the light set 50 is associated with the hanger 30, as subunit 14, the common means 52 is generally relatively short, with the light strings 54 being closely spaced together adjacent the common means 52 (i.e., adjacent the small hanger rim 32), but spreading outwardly and downwardly toward the much larger base rim 22 in the assembled string tree 10.

Each light string 54 contains a plurality of miniature or midget lamps 56 physically and electrically in series or a plurality of screw-in type lamps electrically in parallel. Each lamp 56 is a twinkle bulb, steady burning bulb or the like. The lamps 56 may be regularly or irregularly spaced along the length of the light string 54.

The plug 53 is connected physically and electrically in series with the common wire means 52 by a plug wire 53*a* which preferably travels downwardly along (or inside) the pole means 40 and along (or inside) a base connection means or spoke 27 to and beyond the periphery of the base rim 22.

Further, a "tree-topper ornament" 60 is typically provided with the string tree 10 for being removably secured to the top of the pole means 40. Where this ornament is electrically illuminatable (for example, because it includes a lamp therein), it must be in electrical communication with the light set 50, typically by an additional light string 62 in electrical communication with both the common means 52 and the lamp in ornament 60.

Means 70 are also provided for releasably manually securing the free end of each light string 54 to a respective other one of the hanger engagement means 38 and the base engagement means 28. Thus, when the common means 52 of the light set 50 is associated with the hanger rim 32, as preferred, the free end of each light string 54 is releasably manually secured to a respective base engagement means 28 by a securing means 70. A preferred securing means 70 facilitating simple, easy and fast attachment of the free ends of the light strings 54 to the appropriate engagement means 28, 38 is a plastic or plastic-coated "S"—that is, a double-ended hook. One end of such a hook is insertable into the bight of the free end of the light string 54 and the other is engageable with the appropriate engagement means 28, 38. The various securing means 70 are typically sub-packaged together as a unit, rather than lying loosely in the packaging 12. Alternatively, the securing means 70 may be pre-attached, each to a free end of a respective light string 54 or to a respective engagement means 28, 38. If desired, the securing means 70 may simply be a piece of protective plastic tubing over each of the engaging means 28, 38 to protect the wires of the free ends of the light strings from fraying due to friction.

Figure 3:
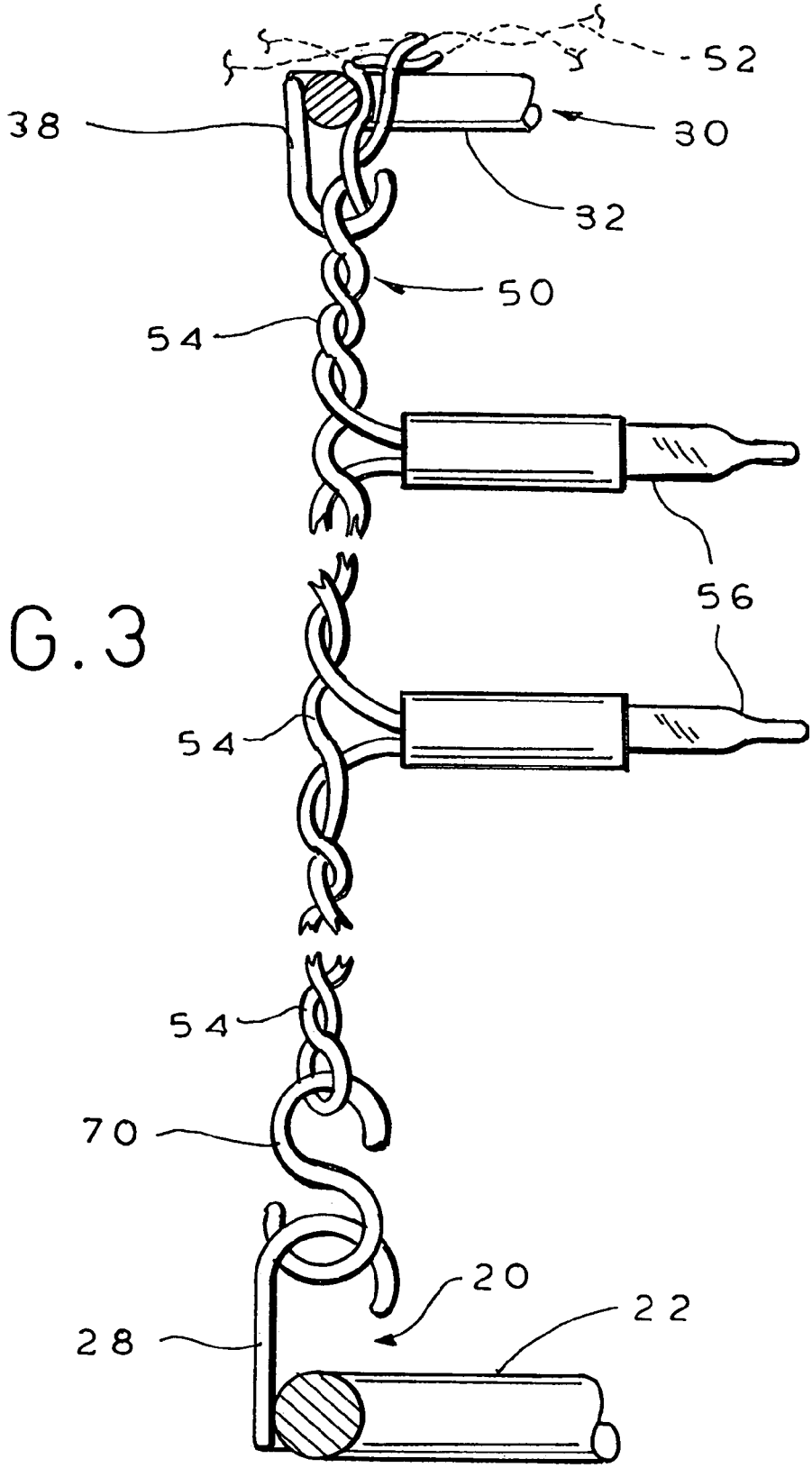
FIG. 3 is a fragmentary front elevational view, to an enlarged scale and partially in section, of a single light string and its connections.

Thus, referring now to FIG. 3 as well, when the string tree 10 is completely assembled, the pole means 40 (with any segments 42 thereof appropriately interfitted) vertically supports the hanger 30 above the base 20, with the light strings 54 extending generally downwardly and outwardly between the hanger engagement means 38 and the base engagement means 28, such that the light strings 54 cumulatively provide the general appearance of an upright truncated cone (which may be topped by the tree-topper ornament 60).

To assemble a string tree 10, the user needs only to assemble the pole means 40 and the hubs 24, 34 with one end of the pole means 40 secured to the base hub 24 and the other end of the pole means 40 secured to the hanger hub 34, thereby to vertically support the hanger 30 above the base 20. In order to maintain some order within the packaging 12 of the string tree 10 prior to assembly thereof, preferably each light string 54 is appropriately individually folded and releasably secured by a rubber band, plastic wrap or the like (not shown) which the user removes in order to allow a full extension of the light string 54 during the assembly process. The light strings 54 are then extended from their associated engagement means 38, 28 (adjacent the common means 52), and the free ends of the light strings 54 are finally manually releasably secured to the other engagement means 28, 38 using the securing means 70, thereby to cause the light strings 54 cumulatively to give the appearance of an upright truncate cone.

To disassemble a string tree 10, the user need only to remove the securing means 70, neatly fold each light string 54 thus freed and then secure the same by a rubber band, plastic wrap or the like relatively close to the common means 52. The removed securing means 70 are then returned to their subpackaging unit. Finally, the hubs 24, 34 are separated from the pole means 40, and the pole means 40 (where applicable) is broken down into the segments 42 thereof. The tree-topper ornament 60, where present, may be removed from the pole means 40.

Those skilled in the art will appreciate that assembly and disassembly of the string tree 10 is relatively simple, easy and quick compared to the intricate procedures required when all of the lamps are on a single light string which must be woven or unwoven upwardly and downwardly repeatedly (either vertically or on an angle) between a hanger and a base.

In order to enable the base 20 to fit within packaging 12 of reasonable size for shipment and storage, instead of an integral base 20 consisting of the base hub 24, base rim 22, and base spokes 26 connecting the same, a base may be divided into a plurality of curved parts (for example, four curved rim segments), with the base spokes pivotally connected at their inner ends to the base hub. The spokes are pivotable between a storage orientation wherein they extend parallel to the vertical axis of the base hub and a use orientation wherein they extend perpendicular thereto and radially outwardly from the base hub. The free ends of the spokes are provided with connecting means such that each curved rim segment is releasably secured to a respective pair of base spokes in the use orientation, thereby to provide an equivalent of integral base 20.

The string tree 10 may additionally be provided with ground stakes (not shown) for securing the base rim 22 into soil.

Figure 4:
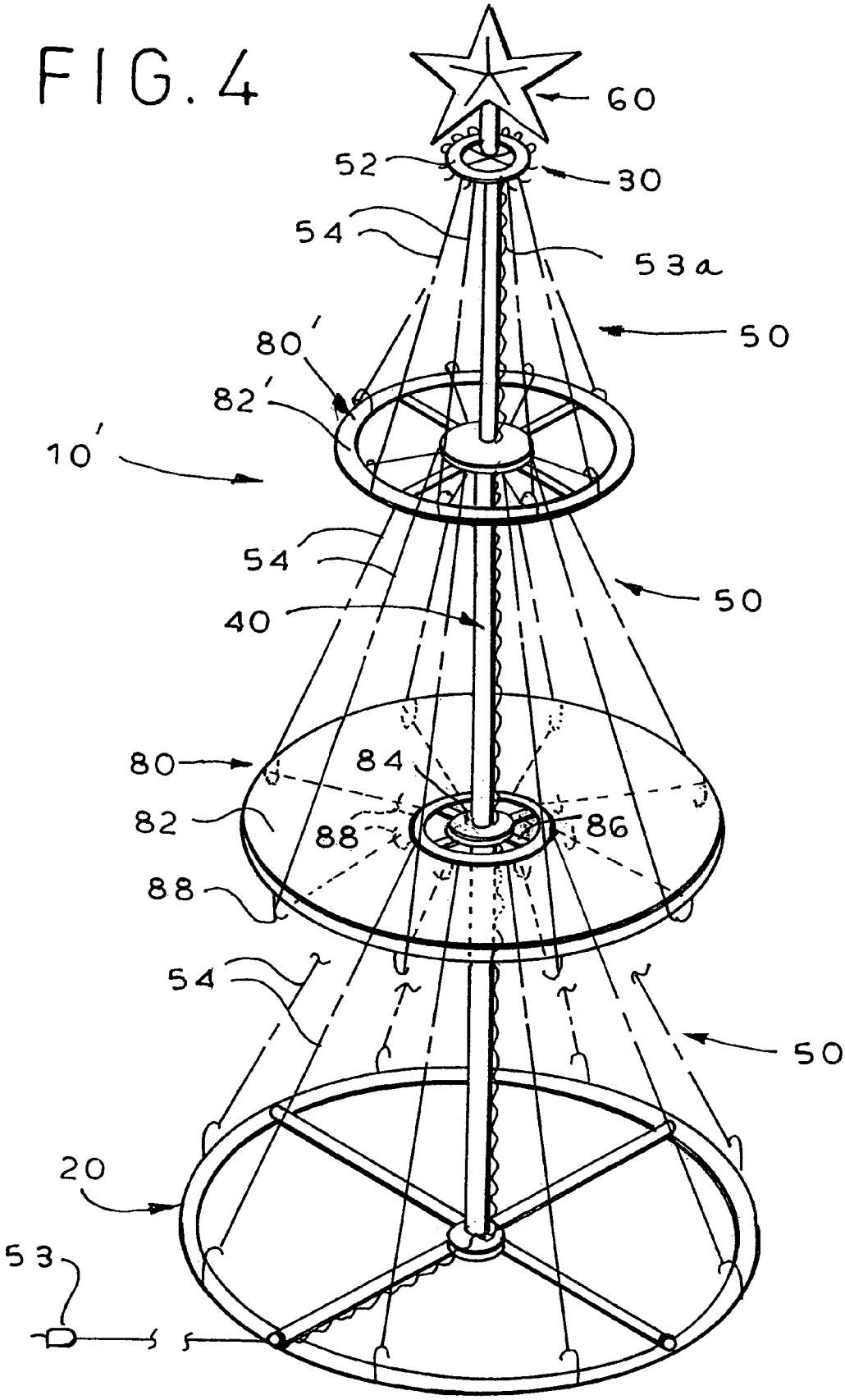
FIG. 4 is an isometic view of a second embodiment of a string tree after complete assembly thereof.

Referring now to FIG. 4 in particular, therein illustrated is a second embodiment of the string tree, generally designated 10'. The string tree 10' is similar to string tree 10, but additionally includes at least one substantially flat or planar wheel-like intermediate structure, generally designated 80. The intermediate structure 80 defines a generally circular intermediate rim 82, an intermediate hub 84 (for releasable attachment to the pole means 40), and a plurality of intermediate connection means 26 connecting the intermediate rim 82 and the intermediate hub 84. The intermediate rim 82 has an outer diameter intermediate the outer diameters of the hanger 30 and base 20 and additionally defines a plurality of circumferentially-spaced intermediate engagement means 88 on the interior, exterior or (as shown) both. The intermediate rim 82 is of appreciable width, and each light string 54 is capable of generally horizontally traversing the width of the intermediate rim 82 and being secured to at least a respective one of the intermediate engagement means 88. Accordingly, when the string tree 10' is completely assembled, the pole means 40 vertically supports the intermediate structure between the hanger 30 and the base 20 with the light strings 54 defining a generally horizontal jag (across the width of the intermediate rim 82) between the hanger 30 and the base 20, such that the light strings 54 cumulatively provide the general appearance of a vertical series of upright truncated cones.

More particularly, when the string tree 10' is completely assembled, each light string 54 engages a respective radially aligned pair of the intermediate engagement means 88 and generally horizontally traverses the width of the intermediate rim 82 (preferably along the underside thereof) such that the light strings 54 cumulatively provide the general appearance of a stack or vertical series of upright truncated cones. The portion of each light string 54 traversing the width of the intermediate rim 82 may optionally be devoid of lamps 66.

The string tree 10' is assembled by the user first assembling the pole means 40 and the hubs 24, 34, 84 with one end of the pole means 40 secured to the base hub 24, the other end of the pole means 40 secured to the hanger hub 34, and an intermediate portion of the pole means 40 secured to the intermediate hub 84. In this manner, the pole means 40 vertically supports the hanger 30 above the base 20 with the intermediate structure 80 therebetween. The user then extends the light strings 54 from respective ones of the hanger and base engagement means 38, 28, and across the intermediate rim 82. The light strings 54 preferably traverse the width of intermediate rim 82 inwardly. Each intermediate portion of each light string 54 is engaged with a respective intermediate engagement means 88, preferably prior to securing of the free ends of the light strings 54. Finally, the user manually releasably secures the free ends of light strings 54 to a respective other one of the hanger and base engagement means 38, 28, using securing means 70, thereby to cause the light strings 54 cumulatively to provide the appearance of a vertical series of upright truncated cones. Preferably the light strings 54 are allowed to depend from the hanger engagement means 38 and the free ends of the light strings 54 are secured to the base engagement means 28 using securing means 70.

An optional second intermediate structure, generally designated 80$^1$, is shown in FIG. 4 between the hanger 30 and the first intermediate structure 80. Its intermediate rim 82$^1$ may be wide, like intermediate rim 82, or (as illustrated) narrow, like the other rims 22, 32.

In particular, generally the intermediate engagement means 88 are disposed on the outer edge of the intermediate rim 22 so that the intermediate portions of the light strings 54 extend inwardly from the intermediate engagement means 88 across the width of the intermediate rim 82, with the light strings 54 then passing downwardly toward the base engagement means 28. (The inner surface of the intermediate rim 82 should be designed in this instance so that it does not abrade the light strings 54.) In particular instances, it may be desirable to have intermediate engagement means 88 not only on the outer periphery of the intermediate rim 82, but also on the inner periphery of the intermediate rim 82, so that the traverse of the intermediate rim 82 by the light strings 54 is maintained substantially horizontal and there is no wearing contact between the intermediate rim 82 and the light strings 54.

Figure 5:
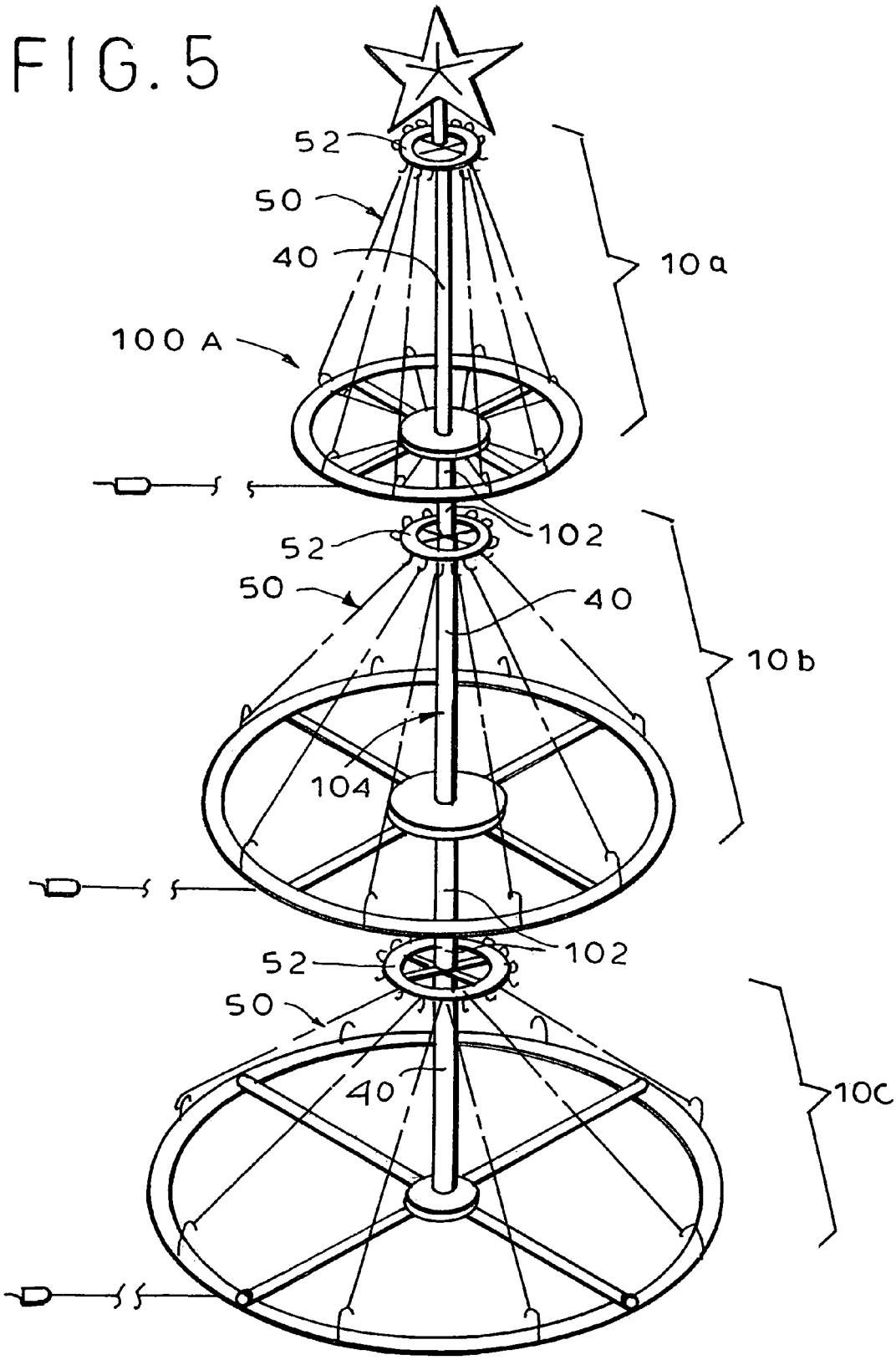
FIG. 5 is a front elevational view of a first embodiment of a string tree composite.
Figure 6:
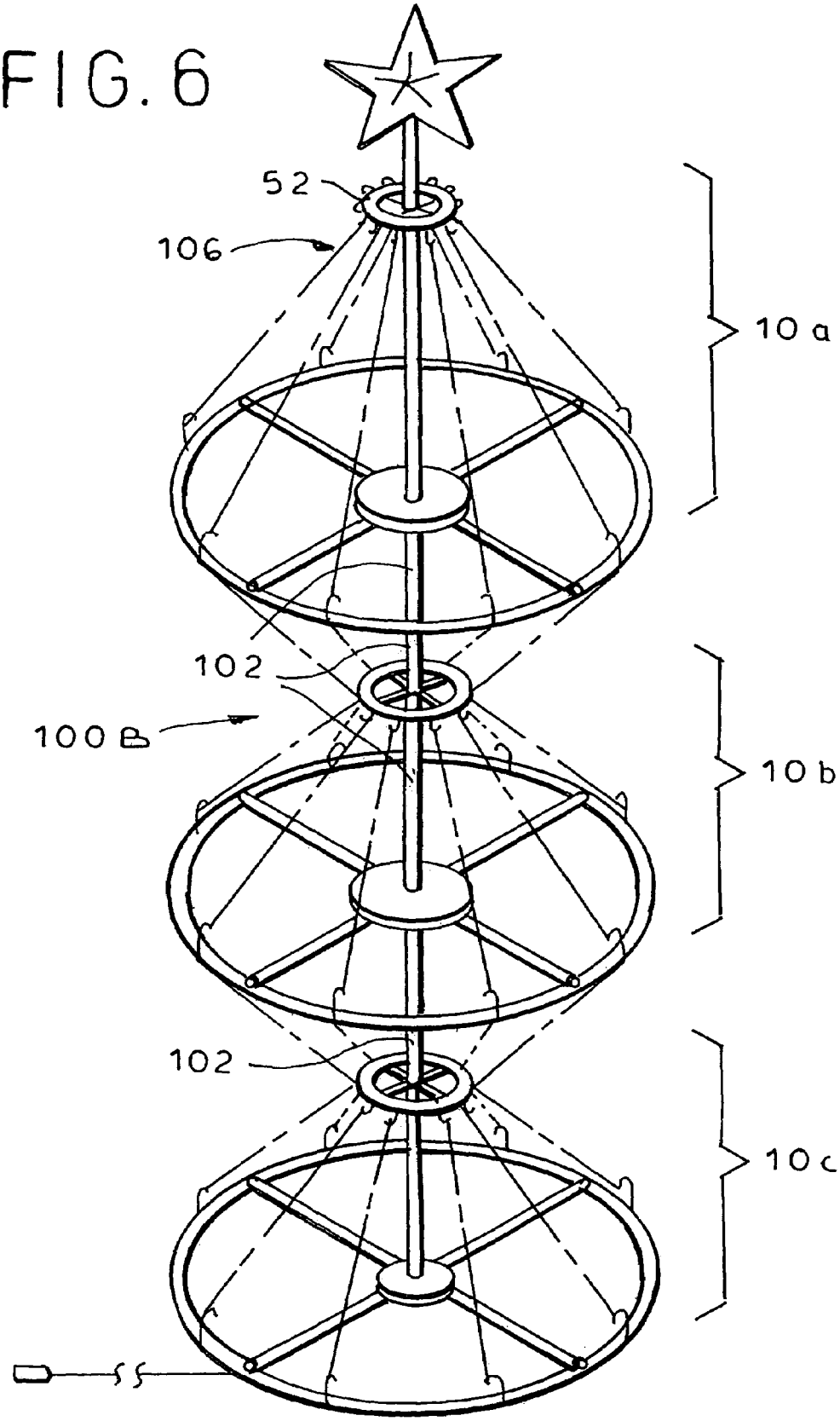
FIG. 6 is a front elevational view of a second embodiment of a string tree composite.

Referring now to FIGS. 5 and 6 in particular, therein illustrated is a string tree composite, generally designed 100. The composite 100 comprises a plurality of the string trees 10, and pole separator means 102 for assembling the plurality of pole means 40 of the plurality of string trees 10 to form a single pole, generally designated 104, joining the plurality of string trees 10 along a vertical axis. Accordingly, when the composite 100 is completely assembled, the pole 104 vertically supports the plurality of string trees 10, one above the other, to form composite 100. The individual string trees 10*a*, 10*b*, 10*c* of a three tree composite 100 are preferably short and spaced apart by the pole separator means 102.

Naturally, in a composite 100 only the top tree 10*a* is provided with a tree-topping ornament 60.

There are two basic embodiments of the composite 100. In the first composite embodiment, generally designated 100A and illustrated in FIG. 5, the plurality of light sets 50 of the plurality of string trees 10 are electrically independent and separate, each with its own common means 52. While each common means 52 is separate and distinct, the various common means 52 may be powered by a single common electrical plug. In the second composite embodiment, generally designated 100B and illustrated in FIG. 6, the plurality of light sets 50 of the plurality of string trees 10 are in electrical communication to form a single large light set 106 having only a single common means 52.

Depending upon the desired appearance of the string tree composite 100, each of the individual string trees 10 of the composite 100 may be of substantially the same size (in particular, the width of the outer periphery of the rims 22, 32 and possibly 82. This is illustrated in connection with the second composite embodiment 100B illustrated in FIG. 6. Alternatively, the string trees may vary in size (and in particular in the widths of the outer peripheries of the rims 22, 32 and optionally 82). This is illustrated in the first composite embodiment 100A illustrated in FIG. 5. Thus FIG. 5 shows the outer periphery of the base rim 22 of the lowest tree 10*c* being of greater diameter than that of the intermediate tree 10*b*, and the outer periphery of the base rim 22 of the topmost tree 10*a* being of the smallest diameter This particular design has the advantage of enhanced stability of the composite.

Clearly the selection of the sizes of the string trees 10*a*, 10*b*, 10*c* is independent of the selection of the light set 50, 104. It should also be appreciated that while the composite 100 has been illustrated in both FIGS. 5 and 6 as comprising a plurality of the string trees 10, a string tree 10' (including an intermediate structure 80) may be substituted for one or more of the string trees 10 in the composite 100.

In FIGS. 5 and 6, the plug wire 53*a* connecting the common means 52 and the electric plug 53 has been omitted to avoid cluttering the view. In FIGS. 2, 4, 5 and 6, the lamps 56 have been omitted for the same reason.

To summarize, the present prevention provides a string tree, characterized by a disassembled planar storage orientation and an assembled conical use orientation. The string tree is easily, simply and quickly converted from one orientation to the other even by a relatively unskilled user. The string tree is simple, easy and economical to manufacture, use and maintain. The present invention also provides a method for simply, easily and quickly assembling and disassembling such a string tree.

Now that the preferred embodiments of the present invention have been shown and described in detail, various modifications and improvements thereon will become readily apparent to those skilled in the art. Accordingly, the spirit and scope of the present invention is to be limited only by the appended claims, and not by the foregoing specification.

I claim:

1. A string tree, prior to complete assembly thereof, comprising:

(A) a substantially planar wheel-like base defining a base rim, a base hub, and base connection means connecting said base rim and said base hub, said base rim additionally defining a plurality of spaced base engagement means;

(B) a substantially planar wheel-like hanger defining a hanger rim, a hanger hub, and a hub connection means connecting said hanger rim and said hanger hub, said hanger rim additionally defining a plurality of spaced hanger engagement means, said hanger rim having a diameter substantially less than that of said base rim;

(C) a pole means for releasable attachment at one end to said base hub and at an opposite end to said hanger hub for thereby connecting said hubs in a vertically spaced relationship;

(D) a light set defining a common means and a plurality of flexible light strings extending therefrom, each said light string containing lamps, being in electrical communication with said common means, and extending from a respective one of one of said hanger engagement means and said base engagement means, said common means being secured to a corresponding one of said hanger rim and said base rim; and (E) means for releasably manually securing the free end of each of said light strings to a respective other one of said hanger engagement means and said base engagement means;

whereby, when said string tree is completely assembled, said pole means vertically supports said hanger above said base with said light strings extending generally downwardly and outwardly between said hanger engagement means and said base engagement means such that said light strings cumulatively provide the general appearance of an upright truncated cone.

2. The string tree of claim 1 additionally including a tree-topper ornament removably securable to the top of said pole means.

3. The string tree of claim 1 wherein said ornament is electrically illuminatable and in electrical communication with said light set.

4. The string tree of claim 3 wherein an additional light string of said light set is in electrical communication with both said common wire means and said ornament.

5. The string tree of claim 1 wherein said common means is secured to said hanger rim, each said light sting extends from a respective one of said hanger engagement means, and said securing means is for manually releasably securing the free end of each said light string to a respective one of said base engagement means.

6. The string tree of claim 1 wherein said base connecting means is a plurality of circumferentially-spaced base spokes.

7. The string tree of claim 1 wherein said hanger connecting means is a plurality of circumferentially-spaced hanger spokes.

8. The string tree of claim 1 wherein said base rim is generally circular.

9. The string tree of claim 1 wherein said hanger rim is generally circular.

10. The string tree of claim 1 wherein said pole means is formed of a plurality of segments configured and dimensioned to be assembled together.

11. The string tree of claim 1 additionally comprising:

(F) at least one substantially planar wheel-like intermediate structure defining an intermediate rim, an intermediate hub for releasable attachment to said pole means, and a plurality of intermediate connection means connecting said intermediate rim and said intermediate hub, said intermediate rim additionally defining a plurality of circumferentially-spaced intermediate engagement means;

said intermediate rim being of appreciable width, and each said light string being capable of generally horizontally traversing the width of said intermediate rim and being securable to at least a respective one of said intermediate engagement means;

whereby, when said string tree is completely assembled, said pole means vertically supports said intermediate structure between said hanger and said base with said light strings defining a generally horizontal jag between said hanger and said base such that said light strings cumulatively provide the general appearance of a vertical series of truncated cones.

12. The string tree of claim 11 wherein, when said string tree is completely assembled, each said light string engages a respective one of said intermediate engagement means and inwardly and generally horizontally traverses the width of said intermediate rim such that said light strings cumulatively provide the general appearance of a stack of upright truncated cones.

13. The string tree of claim 11 wherein said intermediate rim has an outer diameter intermediate said hanger and base diameters.

14. A string tree composite comprising:

(A) a plurality of the string trees of claim 1; and (B) means for assembling the plurality of pole means of said plurality of string trees to form a single pole joining said plurality of string trees along a vertical axis;

whereby, when said composite is completely assembled, said pole vertically supports said plurality of string trees, one above the other, to form the composite.

15. The composite of claim 14 wherein the plurality of light sets of said plurality of string trees are electrically independent and separate.

16. The composite of claim 14 wherein the plurality of light sets of said plurality of string trees are in electrical communication to form a single large light set.

17. A method of assembling a string tree comprising the steps of:

(A) providing the unassembled string tree of claim 1;

(B) assembling the pole means and the hubs with one end of the pole means secured to the base hub and the other end of the pole means secured to the hanger hub, thereby to vertically support the hanger above the base; and (C) extending the light strings from a respective one of the hanger and base engagement means, and manually releasably securing each free end of the light strings to a respective other one of the hanger and base engagement means, thereby to cause the light strings cumulatively to give the appearance of an upright truncated cone.

18. The method of claim 17 wherein the light strings are allowed to depend from the hanger engagement means and the free ends are secured to the base engagement means.

19. A method of assembling a string tree comprising the steps of:

(A) providing the unassembled string tree of claim 11;

(B) assembling the pole means and the hubs with one end of the pole means secured to the base hub, an intermediate portion of the pole means secured to the intermediate hub, and the other end of the pole means secured to the hanger hub, thereby to vertically support the hanger above the base with the intermediate structure therebetween.

(C) extending the light strings from a respective one of the hanger and base engagement means and across the intermediate rim, and manually releasably securing each free end of the light strings to a respective other one of the hanger and base engagement means, thereby to cause the light strings cumulatively to give the appearance of a vertical series of upright truncated cones.

20. The method of claim 19 additionally including the step of engaging each intermediate portion of each light string with a respective intermediate engagement means.

* * * * *

US007152998C1

(12) EX PARTE REEXAMINATION CERTIFICATE (9511th)

United States Patent

Rahman

(10) Number: US 7,152,998 C1

(45) Certificate Issued: Feb. 11, 2013

(54) ASSEMBLABLE STRING TREE

(75) Inventor: Najeh Rahman, Harriman, NY (US)

(73) Assignee: Sienna LLC, Oakland, NJ (US)

Reexamination Request:
No. 90/012,068, Dec. 21, 2011

Reexamination Certificate for:

| | |
|---|---|
| Patent No.: | **7,152,998** |
| Issued: | **Dec. 26, 2006** |
| Appl. No.: | **10/849,727** |
| Filed: | **May 20, 2004** |

(51) Int. Cl.
*F21S 13/14* (2006.01)

(52) U.S. Cl. ..... 362/249.19; 362/123; 362/806

(58) Field of Classification Search ..... None
See application file for complete search history.

(56) References Cited

To view the complete listing of prior art documents cited during the proceeding for Reexamination Control Number 90/012,068, please refer to the USPTO's public Patent Application Information Retrieval (PAIR) system under the Display References tab.

*Primary Examiner* — John O Heyman

(57) ABSTRACT

An assemblable string tree wherein, when completely assembled, a pole vertically supports a hanger above a base with light strings extending generally downwardly and outwardly between hanger engagements and base engagements such that the light strings cumulatively provide the general appearance of an upright truncated cone.

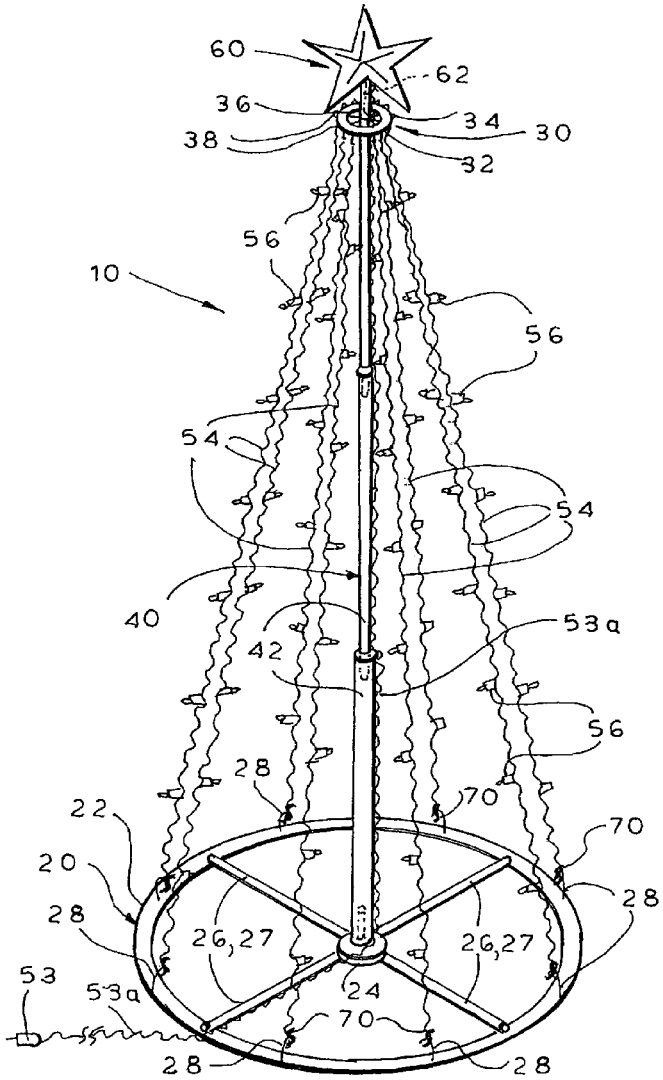

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1-10, 17 and 18 is confirmed.

Claims 11-16, 19 and 20 were not reexamined.

* * * * *

US007152998C2

(12) EX PARTE REEXAMINATION CERTIFICATE (10054th)

United States Patent

Rahman

(10) Number: US 7,152,998 C2

(45) Certificate Issued: Feb. 25, 2014

(54) ASSEMBLABLE STRING TREE

(75) Inventor: Najeh Rahman, Harriman, NY (US)

(73) Assignee: Sienna LLC, Oakland, NJ (US)

Reexamination Request:
No. 90/012,989, Sep. 12, 2013

Reexamination Certificate for:

| | |
|---|---|
| Patent No.: | **7,152,998** |
| Issued: | **Dec. 26, 2006** |
| Appl. No.: | **10/849,727** |
| Filed: | **May 20, 2004** |

Reexamination Certificate C1 7,152,998 issued Feb. 11, 2013

(51) Int. Cl.
*F21S 13/14* (2006.01)

(52) U.S. Cl.
USPC ..... 362/249.19; 362/123; 362/806

(58) Field of Classification Search
None
See application file for complete search history.

(56) References Cited

To view the complete listing of prior art documents cited during the proceeding for Reexamination Control Number 90/012,989, please refer to the USPTO's public Patent Application Information Retrieval (PAIR) system under the Display References tab.

*Primary Examiner* — Kenneth J Whittington

(57) ABSTRACT

An assemblable string tree wherein, when completely assembled, a pole vertically supports a hanger above a base with light strings extending generally downwardly and outwardly between hanger engagements and base engagements such that the light strings cumulatively provide the general appearance of an upright truncated cone.

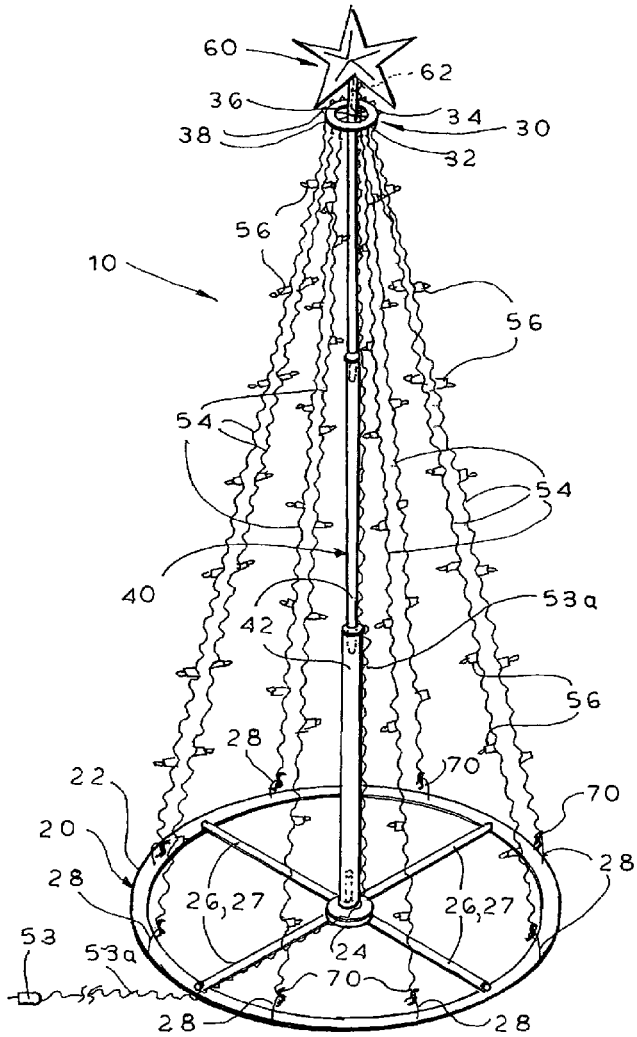

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1-10, 17 and 18 is confirmed.

Claims 11-16, 19 and 20 were not reexamined.

* * * * *